US011454936B2

(12) United States Patent
Dupont-Nivet

(10) Patent No.: US 11,454,936 B2
(45) Date of Patent: Sep. 27, 2022

(54) COOLING SYSTEM FOR A COLD ATOMS SENSOR AND ASSOCIATED COOLING METHOD

(71) Applicant: THALES, Courbevoie (FR)

(72) Inventor: Matthieu Dupont-Nivet, Palaiseau (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/250,135

(22) PCT Filed: Jun. 4, 2019

(86) PCT No.: PCT/EP2019/064439
§ 371 (c)(1),
(2) Date: Dec. 4, 2020

(87) PCT Pub. No.: WO2019/233987
PCT Pub. Date: Dec. 12, 2019

(65) Prior Publication Data

US 2021/0232101 A1 Jul. 29, 2021

(30) Foreign Application Priority Data

Jun. 7, 2018 (FR) ..... 1800578

(51) Int. Cl.
*G04F 5/14* (2006.01)
*G21K 1/00* (2006.01)

(52) U.S. Cl.
CPC ..... *G04F 5/14* (2013.01); *G21K 1/006* (2013.01)

(58) Field of Classification Search
CPC ..... G04F 5/14; G21K 1/006
See application file for complete search history.

(56) References Cited

U.S. PATENT DOCUMENTS

2015/0200029 A1 7/2015 Hughes et al.
2018/0158660 A1* 6/2018 Naito ..... H01J 49/26
2021/0232101 A1* 7/2021 Dupont-Nivet ..... G04F 5/14

FOREIGN PATENT DOCUMENTS

FR 2 730 845 A1 8/1996

OTHER PUBLICATIONS

Ben-Chang, Zheng, et al. "Development of an integrating sphere cold atom clock." Chinese Physics Letters 30.12 (2013): 123701. (Year: 2013).*

(Continued)

*Primary Examiner* — Wyatt A Stoffa
(74) *Attorney, Agent, or Firm* — BakerHostetler

(57) ABSTRACT

A cooling system for a cold-atom sensor, this system includes a two-dimensional cooling chamber, called the 2D chamber (Ch2D), kept under ultra-high vacuum and placed at least partially inside an integrating cylinder (IC) having a Z-axis, the integrating cylinder being configured to illuminate the 2D chamber with a first isotropic light (IL1), the 2D chamber comprising atoms to be cooled, a three-dimensional cooling chamber, called the 3D chamber (Ch3D), kept under ultra-high vacuum and joined to the 2D chamber by an aperture (Op) configured to allow the atoms to pass from the 2D chamber to the 3D chamber via movement substantially along the Z-axis, the 3D chamber being placed at least partially inside an integrating sphere (IS), the integrating sphere being configured to illuminate the 3D chamber with a second isotropic light (IL2).

15 Claims, 11 Drawing Sheets

(56) References Cited

OTHER PUBLICATIONS

Ketterle, et al., "Slowing and cooling atoms in isotropic laser light", Physical Review Letters, vol. 69(17), pp. 2483-2486, Oct. 26, 1992.
Tremine, et al., "Isotropic light vs six-beam molasses for doppler cooling of atoms from background vapor—theoretical comparison", arxiv.org., Cornell University Library, May 26, 2017.
Farkas, et al., "A compact, transportable, microchip-based system for high repetition rate production of Bose-Einstein condensates", JILA and Department of Physics, 2009.
Aardema et al. "Tranverse diffusion in Isotropic Light Slowing", Physical Review Letters, vol. 76, No. 5, 1996.
Cheng et al. "Laser cooling of rubidium atoms from background vapor in diffuse light", Physical Review, A 79, No. 023407, 2009.

* cited by examiner

COOLING SYSTEM FOR A COLD ATOMS SENSOR AND ASSOCIATED COOLING METHOD

CROSS-REFERENCE TO RELATED APPLICATIONS

This application is a National Stage of International patent application PCT/EP2019/064439, filed on Jun. 4, 2019, which claims priority to foreign French patent application No. FR 1800578, filed on Jun. 7, 2018, the disclosures of which are incorporated by reference in their entirety.

FIELD OF THE INVENTION

The invention relates to the field of cold-atom sensors. More particularly, the invention relates to the systems for laser cooling atoms that allow such sensors (100 μK class) to be employed.

BACKGROUND

Cold-atom sensors have already exhibited excellent performance in the measurement of time (clock) and gravitational fields (gravimeter), accelerations (accelerometer) and rotations (gyrometer). Their operating principle is reviewed below.

To take a measurement, a cold-atom sensor requires a cloud of cold atoms, i.e. atoms that have been slowed in three spatial directions, to be obtained in a vacuum chamber. This cloud of atoms cooled in three dimensions will be denoted AC3D (typical temperature in the 100 μK class).

The atoms used in cold-atom sensors are such that they have two so-called "hyperfine" ground atomic states, i.e. states that are separated in frequency by a quantity $\delta f_0$ of about one gigahertz, with $\delta f_0=\omega_0/2\pi$, that is very stable and very well known.

These atoms are typically atoms of rubidium 87, for which $\delta f_0$=6.834 GHz, but other alkali-metal atoms such as atoms of rubidium 85 ($\delta f_0$)=3.0 GHz) cesium ($\delta f_0$)=9.2 GHz), sodium ($\delta f_0$=1.7 GHz) or potassium 40 ($\delta f_0$=1.3 GHz) have the same type of atomic structure and may be used.

As regards the implementation of the sensor, a line is drawn between the preparation of the atoms, which consists in producing the aforementioned cloud AC3D, and the actual measurement (clock, velocity, acceleration, rotation) using AC3D.

To prepare the atoms in order that they may be used for the measurement, a line is drawn between the following:

a cooling phase, at the end of which the cloud AC3D is formed, with atoms populating one of the two hyperfine ground states, which state will be denoted F0, and a pumping phase, at the end of which all the atoms of AC3D are in a determined Zeeman sub-level, which will be denoted Z0, of the state F0.

Conventionally, these phases are carried out using laser light and magnetic fields (see below).

One generation of cold-atom sensors uses an atom chip to guide the path of the one or more clouds of cold atoms and to take the measurement. With this type of sensor, the optical pumping phase is important as otherwise all the atoms will not be in the same Zeeman sub-level Z0 of F0 able to be trapped by the atom chip.

Once the cloud of cold atoms AC3D has been formed (typical temperature in the 100 μK class), the atoms being positioned in the desired Zeeman sub-level Z0, the atoms are transferred or "loaded" to within the vicinity of the atom chip by turning on a magnetic elevator. Once the cloud is in the vicinity of the chip, the elevator is turned off and the "hottest" atoms are removed for example by radiofrequency evaporation (second cooling), the remaining atoms then being said to be ultracold (100 nK class).

A measurement is then carried out using microcircuits present on the chip (clock, velocity, acceleration, rotation), this consisting in transferring a phase accumulated by the atomic wave function during the measurement into a population difference between two Zeeman sub-levels.

The measurement is read out by counting the number of atoms in the various Zeeman sub-levels involved in the preceding measurement. This readout is carried out using a detection laser that illuminates the cloud of ultra-cold atoms. This is the detection phase.

To be able to employ atom-chip sensors, it is necessary to provide a sufficient number of ultra-cold atoms (100 nK class). To effectively cool atoms of the 100 μK class (laser cooling) to the 100 nK class, it is necessary to provide a high number of cold atoms (100 μK class), and typically $10^9$ atoms.

Existing solutions for cooling atoms (100 μK class) combine a two-dimensional magneto-optical trap such as illustrated in FIG. 1 and a three-dimensional magneto-optical trap such as illustrated in FIG. 2. Such a combination is for example described in the reference: D. Farkas, K. Hudek, E. Salim, S. Segal, M. Squires and D. Anderson, "A compact, transportable, microchip-based system for high repetition rate production of Bose-Einstein condensates", Appl. Phys. Lett., 96 (2010).

FIG. 1 illustrates the magneto-optical trap forming the two-dimensional trap or 2D MOT (MOT being the abbreviation of magneto-optical trap). By 2D trap what is meant is the fact that the atoms are slowed by decreasing to zero their velocity in a given plane; in FIG. 1 the given plane is the XY-plane perpendicular to Z.

For the 2D MOT the following are required: 6 laser beams MOT-B that simultaneously illuminate, in 6 different directions, a first chamber; and magnetic fields for example produced by four coils IC (and optionally 2 coils AHC in an anti-Helmholtz configuration). The cloud AC2D is made up of atoms slowed in the XY-plane (their temperature in this plane is in the 100 μK class) but not along the Z-axis (temperature in this direction corresponding to the ambient temperature).

The cloud AC2D is then directed through an aperture into a second chamber in which, such as illustrated in FIG. 2, it is simultaneously illuminated by 6 laser beams in 3 different directions (2 counter-propagating beams per direction), two in the plane of the paper and one in a direction perpendicular to the paper, these directions commonly being denoted MOT 3D X1, MOT 3D X2 and MOT 3D H. A system (not shown) of coils that is identical to that of FIG. 1 is also required to apply a magnetic field similar to that applied in the first chamber.

In the volume illuminated by the intersection of the 6 beams is formed the cloud AC3D of atoms slowed in three directions. Typically, a temperature in the 100 μK class is obtained in the three directions.

An atom chip Atc is placed in the second chamber, to take the measurements, once the cloud AC3D is "loaded" into the chip.

The advantage of a 2-step system is that the 2D MOT supplies the 3D MOT with a high number of pre-cooled atoms, this allowing the 3D MOT to cool a high number of atoms while keeping an ultrahigh vacuum (about $10^{-10}$ mbar) in its chamber. If the 3D MOT were supplied directly with hot atoms, the supply thereof would increase the pressure in the chamber containing the 3D MOT, preventing a measurement from being taken by the atom chip.

Cooling such as illustrated in FIGS. 1 and 2 works but has the drawback of being very complex to implement. Specifically, the following are required:

- 12 laser beams (6 for the two-dimensional magneto-optical trap and 6 for the three-dimensional magneto-optical trap), the frequency, polarization and power of which must be controlled. In addition, these laser beams must be collimated, their forms controlled and their focus sufficiently stable. Typically, the two vertical beams (along Z) of FIG. 1 and the six beams of FIG. 2 have a diameter of 25 mm. The four remaining beams of FIG. 1 typically measure 25 mm by 50 mm.
- two magnetic fields:
  - a first magnetic field having a specific spatial configuration (zero at the center of the magneto-optical trap and increasing with distance from the center) and applied simultaneously in the two chambers by two associated systems. This first field is typically generated:
    - in the first chamber, by four coils IC or four permanent magnets (see FIG. 1 and the aforementioned publication Farkas 2010),
    - in the second chamber, by two coils in anti-Helmholtz configuration;
  - a second magnetic field (uniform, of about 2 gauss) only applied to the second chamber is typically generated by two coils AHC in anti-Helmholtz configuration.

The complexity and the number of the laser beams and of the magnetic fields required in the prior-art solutions make the rapid generation (less than 100 ms) of a sufficient number of cold atoms ($10^9$ atoms at 100 μK) very complex to achieve and to miniaturize.

As regards the magneto-optical operation of the system, by way of nonlimiting example, the principle of the sensor is described with respect to atoms of rubidium 87, which is a commonly used atom. This principle is applicable to the other aforementioned types of atom having two hyperfine ground states.

FIG. 3 illustrates the main atomic states of interest of rubidium 87.

The two hyperfine ground states, which are denoted F=1 and F=2 for rubidium 87, are separated by $\delta f_0=6834\pm1$ MHz. The excited states F'=0, 1, 2 and 3 are obtained by optical excitation in the vicinity of 780 nm, and are separated from one another by quantities comprised between 50 and 300 MHz. The quantity F is defined as the atomic angular momentum.

FIG. 4 illustrates the frequencies required in the three aforementioned phases (cooling, pumping, detection).

In the cooling phase 1, a three-dimensional magneto-optical trap is formed. To do this, a first laser L1, called the cooling laser, is adjusted to a frequency $f_{Refroid}$ that is slightly below an excited frequency, i.e. below by a quantity ε1 typically comprised between a few MHz and one hundred MHz. The atoms absorb photons of L1 and reemit them at a slightly higher frequency (frequency corresponding to the transition frequency F=2→F'=3); thus, they lose kinetic energy and slow down. The laser L1 must have a (left or right circular) polarization $\sigma^+$ or $\sigma^{31}$.

During the cooling, to get all the atoms into the same ground state F0, F=2 for rubidium 87, a second laser L2, called the "repump" laser, of frequency $f_{Repomp}$, is used, this laser optically pumping the atoms into the state F=2. The states are chosen using spectral selection rules for the atom in question.

In this cooling phase, the 12 laser beams of the two traps 2D MOT and 3D MOT simultaneously illuminate the two chambers, and each beam contains the two frequencies $f_{Refroid}$ and $f_{Repomp}$ of the two lasers L1 and L2.

The first magnetic field described above is also simultaneously applied to the two chambers.

Once the atoms have been cooled, they will all be in the same state F0, F=2 for rubidium 87, but will be distributed over all the Zeeman sub-levels of the state F0 (rubidium 87 has 5).

The optical pumping second phase consists in placing all the atoms in the same predetermined Zeeman sub-level Z0 of the ground state F=2. This phase is important because at the end of the cooling the atoms populate all the Zeeman levels of F=2, and it is desired to maximize the number of atoms in a determined Zeeman level Z0 (the one that will be "loaded" into the atom chip) to maximize the number of atoms "loaded" into the atom chip.

FIG. 5 illustrates the various Zeeman sub-levels snZ of the states F=1 and F=2 of rubidium 87 (these are not shown in FIG. 4). As may be seen, the state F=2 has 5 Zeeman sub-levels. For a given ground state, the Zeeman sub-levels are characterized by the value of the quantity $m_F$ corresponding to the projection of the atomic angular momentum F onto the quantification axis. Such as illustrated in FIG. 5, one Zeeman sub-level is thus described by its value of F and its value of $m_F$ using the formalism $|F=2;m_F=2>$, this sub-level being the sub-level of F=2 for which $m_F=2$.

For rubidium 87, the predetermined sub-level Z0 is the level $|F=2;m_F=2>$.

During this second phase, a uniform magnetic field is applied to the chamber containing the 3D MOT, to remove the degeneracy of the various Zeeman sub-levels, i.e. to give each Zeeman sub-level a different energy allowing them to be discriminated between. According to a known relationship, the various resonant frequencies corresponding to the transitions between a Zeeman sub-level of F=1 and a Zeeman sub-level of F=2 are dependent on the strength of this uniform magnetic field.

This field is typically generated with a pair of coils in Helmholtz configuration.

The laser L1, which is here GE polarized (right circular polarized), is reused as laser for the pumping (it then illuminates the atomic cloud in a direction other than that used during the cooling); it must be at a frequency $f_{pomp}$ below a determined transition by a quantity ε2 of about 160 to 260 MHz.

The second laser L2, which is called the "repump" laser, is also used to bring all the atoms to the ground state F=2.

During this second phase, the two lasers L1 and L2 only illuminate the chamber containing the 3D MOT.

In a detecting third phase (after a certain interferometry time) only the laser L1 is used, here as detection laser, with a frequency $f_{det}$ adjusted to an atomic resonance.

As a variant of this third phase, the lasers L1 and L2 may be used sequentially or simultaneously.

Thus, prior-art cold-atom-sensor cooling systems capable of delivering a certain number of cold atoms in the 100 μK range are expensive and complex to produce and to employ.

SUMMARY OF THE INVENTION

One aim of the present invention is to remedy the aforementioned drawbacks by providing a simplified cooling system using a cooling principle based on isotropic light.

One subject of the present invention is a cooling system for a cold-atom sensor, this system comprising:

a two-dimensional cooling chamber, called the 2D chamber, kept under ultra-high vacuum and placed at least partially inside an integrating cylinder having a Z-axis, said integrating cylinder being configured to illuminate the 2D chamber with a first isotropic light, said 2D chamber comprising atoms to be cooled, a three-dimensional cooling chamber, called the 3D chamber, kept under ultra-high vacuum and joined to the 2D chamber by an aperture (Op) configured to allow said atoms to pass from the 2D chamber to the 3D chamber via movement substantially along the Z-axis, said 3D chamber being placed at least partially inside an integrating sphere, said integrating sphere being configured to illuminate the 3D chamber with a second isotropic light.

Typically, the atoms are rubidium.

According to one embodiment, the 2D chamber is furthermore configured to be illuminated, via a porthole, with a laser beam along the Z-axis.

According to one embodiment, the first isotropic light and the second isotropic light respectively originate from a first and a second set of optical fibers respectively connected to the integrating cylinder and to the integrating sphere via associated inputs.

Typically, the first set consists of four multimode optical fibers, the four associated inputs being placed in the same plane perpendicular to the Z-axis and passing through the middle of the height of said cylinder, and being spaced apart by 90°.

Typically, the second set consists of four multimode optical fibers, the four associated inputs being placed so that two thereof are radially opposite and located on a straight line passing through the center of the sphere, the two other inputs being located in a plane perpendicular to said straight line and containing the center of the sphere.

According to one embodiment, the integrating sphere furthermore has two apertures allowing a detection beam to pass.

Preferably, the optical fibers are configured so that an optical field inside the sphere exhibits fine-grain speckle.

Preferably, the internal surface of said integrating cylinder and the internal surface of the integrating sphere are each either a high-reflectivity mirror, or perfectly scattering.

According to one embodiment, the cooling system according to the invention furthermore comprises a device for generating a uniform magnetic field in the 3D chamber, and a device for generating a microwave-frequency wave that propagates into the 3D chamber, said microwave-frequency wave having a plurality of frequencies.

According to another aspect, the invention relates to an atom-chip cold-atom sensor comprising an atom source, a cooling system according to the invention, and an atom chip placed inside the 3D chamber or forming at least partially one of the walls of said 3D chamber.

According to one variant, the atom chip forms at least partially one wall of the 3D chamber and is transparent, the face that is not in vacuum being coated with a scattering or reflective layer.

According to yet another aspect, the invention relates to a method for the cooling atoms for an atom-chip cold-atom sensor, said sensor comprising:

a two-dimensional cooling chamber, called the 2D chamber, kept under ultra-high vacuum and comprising atoms to be cooled, said 2D chamber being placed at least partially inside an integrating cylinder having a Z-axis, said integrating cylinder being configured to illuminate the 2D chamber with a first isotropic light, a three-dimensional cooling chamber, called the 3D chamber, kept under ultra-high vacuum and joined to the 2D chamber by an aperture configured to allow said atoms to pass from the 2D chamber to the 3D chamber via movement substantially along the Z-axis, said 3D chamber being placed at least partially inside an integrating sphere, said integrating sphere being configured to illuminate the 3D chamber with a second isotropic light, said atoms to be cooled having a first and a second ground state, said states being hyperfine, the method comprising:

a cooling first phase implemented during a first period of time consisting in cooling the atoms and in placing them in one of the two hyperfine ground states, which state is called F0, this comprising a step of illuminating the 2D chamber and the 3D chamber with the first and second isotropic light, respectively, said isotropic lights having a cooling frequency and a repump frequency, an optical pumping second phase, implemented after the isotropic lights have been turned off during a second period of time, said second phase being implemented during a third period of time and being intended to place the atoms in a determined Zeeman sub-level of the ground state, said second phase comprising steps, implemented simultaneously in the 3D chamber, of:

applying a uniform magnetic field, illuminating with the second isotropic light having the repump frequency, illuminating with a microwave-frequency wave having a plurality of different frequencies, each frequency corresponding to a resonant frequency of a transition between a Zeeman sub-level of the first ground state and a Zeeman sub-level of the second ground state.

According to one embodiment, during the cooling phase, the 2D chamber is also illuminated, along the Z-axis of the cylinder, with a laser beam having the cooling frequency and the repump frequency.

Typically, the atoms to be cooled are atoms of rubidium 87, the two hyperfine ground states being called F=1 and F=2, the ground state being the state F=2 and the predetermined Zeeman sub-level being the sub-level denoted $|F=2; m_F=2>$, with F the atomic angular momentum and $m_F$ the projection of the atomic angular momentum onto the quantification axis, and wherein the plurality of frequencies consists of four frequencies, with:

a first frequency corresponding to the frequency of the transition $|F=1;m_F=-1>$ to $|F=2;m_F=-2>$, a second frequency corresponding to the frequency of the transition $|F=1;m_F=0>$ to $|F=2;m_F=-1>$, a third frequency corresponding to the frequency of the transition $|F=1; m_F=1>$ to $|F=2;m_F=0>$, and a fourth frequency corresponding to the frequency of the transition $|F=1;m_F=1>$ to $|F=2;m_F=1>$.

According to a last aspect, the invention relates to a measuring method carried out by a cold-atom sensor comprising an atom chip placed inside the 3D chamber or forming one of the walls of said 3D chamber, the method comprising:

a cooling step carried out using the cooling method according to the invention, a step of transferring atoms to nearby the atom chip with a magnetic elevator, a step of trapping said atoms in the atom chip in order to cool them once more, a measuring step carried out by microcircuits present in the atom chip, a detecting step carried out using a detection laser beam that illuminates said 3D atoms located nearby the atom chip.

BRIEF DESCRIPTION OF THE DRAWINGS

Other features, aims and advantages of the present invention will become apparent on reading the following detailed description with reference to the appended drawings, which are given by way of non-limiting example and in which.

DETAILED DESCRIPTION

Figure 6:
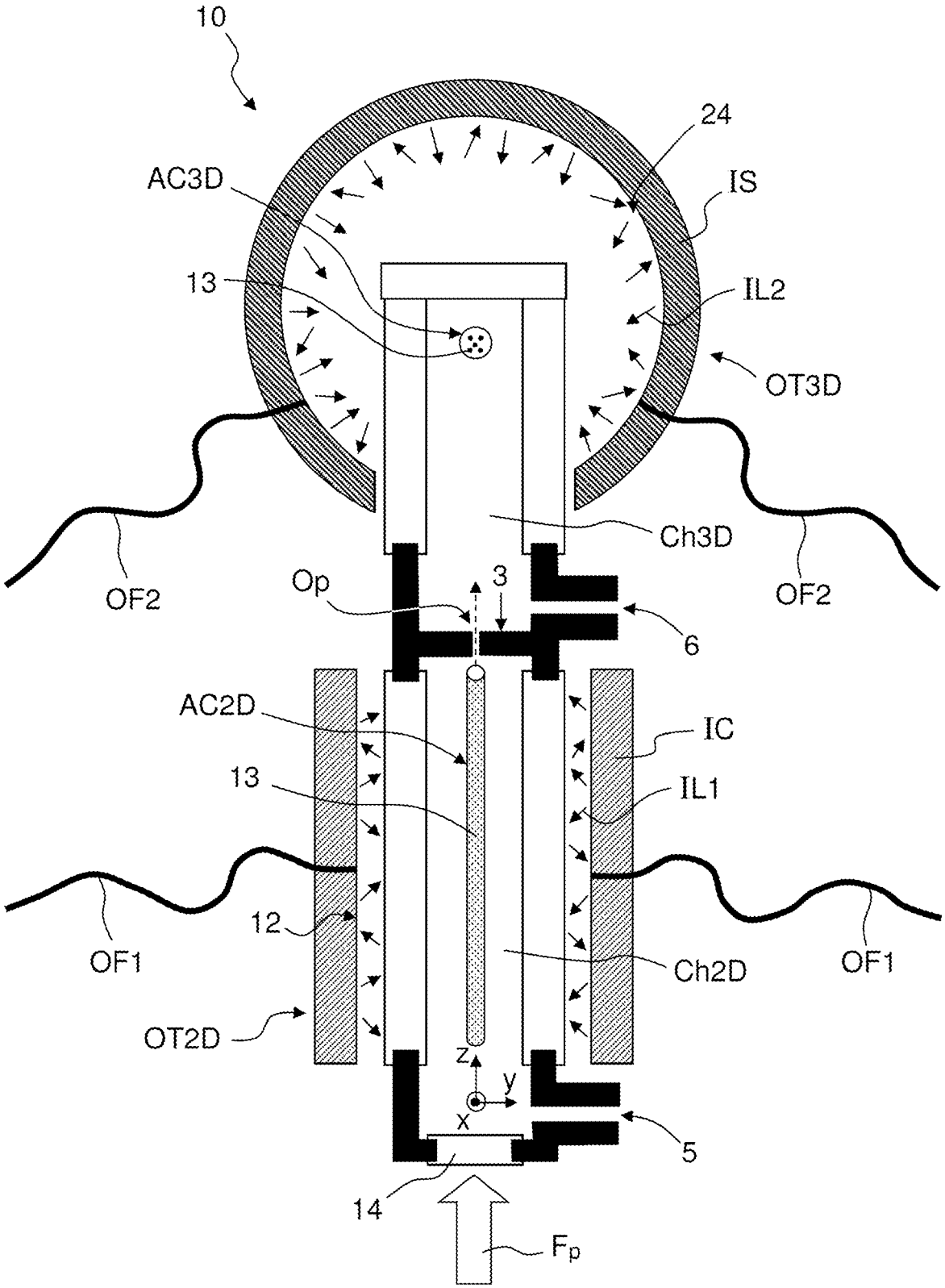
FIG. 6 illustrates a cooling system for a cold-atom sensor, according to the invention.

The cooling system 10 for a cold-atom sensor, according to the invention, is illustrated in FIG. 6.

It uses isotropic light cooling, the principle of which is described in the publication by T. G. Aardena et al. "Tranverse diffusion in Isotropic Light Slowing" Physical Review Letters Vol 76, No. 5, 1996. In this publication, a previously collimated beam of atoms is cooled in two directions.

This principle is based on the exchange of momentum between the photons absorbed and emitted by the atom to be cooled. Let an atom of velocity v, the atom to be cooled, absorb photons the momentum of which is on the surface of a cone of angle θ, such that:

$$f_{atom}=f_{Refroid}+[f_{Refroid}V\cos(\theta)]/c$$

where c is the speed of light and $f_{atom}$ is the frequency of the transition used for the cooling; in the case of rubidium 87 it is the frequency of the transition F=2→F'=3. On average over many cycles of absorption/emission of photons by the atom to be cooled: i) the average of the momentum of the photons re-emitted by the atom is zero, ii) the average of the projections into the plane perpendicular to the velocity of the atom of the momentums of the photons absorbed by the atom is zero, iii) the average of the projections in the direction of the velocity of the atom of the momentums of the photons absorbed by the atom is nonzero and is opposite to the velocity of the atom. Therefore, a force that slows the atom and therefore cools it is generated thereby.

In the aforementioned publication, only two-dimensional isotropic light cooling is described.

The publication by H. D. Cheng et al. "Laser cooling of rubidium atoms from background vapor in diffuse light" Physical Review A Vol 79, No. 023407, 2009, describes three-dimensional isotropic cooling that allows only a low number of cooled atoms to be obtained.

The cooling system 10 according to the invention comprises two cooling chambers, a 2D chamber and a 3D chamber, and is based on the combination of an integrating cylinder and sphere, as described below.

A two-dimensional cooling chamber Ch2D or 2D chamber is kept under ultra-high vacuum using a system of pumps (not shown) connected to the duct 5. The 2D chamber is placed at least partially inside an integrating cylinder IC having a symmetry of revolution about a Z-axis.

Atoms 13 to be cooled are present in the 2D chamber. These atoms are preferably atoms of rubidium 87 but may also be atoms of rubidium 85, of cesium, of sodium or potassium 40.

According to one option, these atoms originate from a source, such as a filament (not shown), placed inside the 2D chamber. According to another option, these atoms originate from an additional chamber connected to the 2D chamber. The 2D chamber is used to "load" the 3D chamber with pre-cooled atoms.

The integrating cylinder is configured to illuminate the 2D chamber with a first isotropic light IL1. When it illuminates the 2D chamber, the first isotropic light has two frequencies (defined with reference to the prior art): the cooling frequency $f_{Refroid}$ and the repump frequency $f_{Repomp}$ (see method below).

Preferably, the internal surface 12 of the cylinder IC consists either of a high-reflectivity mirror, for example one made of copper with an optical polish, or of a perfectly scattering material, Spectralon™ for example. The objective is to illuminate the 2D chamber with, in an XY-plane, light rays coming in an equivalent manner from all directions, and to achieve a light field that exhibits translational symmetry along the Z-axis.

Preferably, the 2D chamber Ch2D is also cylindrical in shape and its walls are made of glass that is transparent at the wavelength of operation, which is about 780 nm for rubidium 87.

The isotropic light illuminating the atoms 13 allows the atoms 13 contained in Ch2D to be cooled in an YX-plane perpendicular to Z and perpendicular to the plane of FIG. 6 (see below the section on the cooling method). Combined with the integrating cylinder IC, the 2D chamber is configured to form a two-dimensional optical trap OT2D for atoms 13 present in the 2D chamber. The atoms thus cooled form along Z a cloud AC2D of filamentary shape, this cloud being located at the center of the cylinder.

The cloud AC2D then passes into the 3D chamber Ch3D through an aperture Op that connects Ch2D and Ch3D, and that allows atoms of the cloud AC2D to pass from the 2D chamber to the 3D chamber via movement substantially along the Z-axis.

The aperture Op is typically about one millimeter in diameter and about a few millimeters deep. Preferably, this hole for passage of the atoms between the two chambers is made in a planar part 3 made of OFHC copper the surface of which has an optical polish. This allows, in addition to the two-dimensional cooling already mentioned, the atoms to be pre-cooled in the vertical direction. This increases the number of atoms cooled in the three-dimensional cooling chamber Ch3D.

Preferably, the 2D chamber is furthermore configured to be illuminated, via a porthole 14, by a push laser beam Fp directed along the Z-axis of the cylinder, as illustrated in FIG. 6. Typically its diameter is about one cm. It allows the three-dimensional cooling chamber to be loaded more rapidly by pushing AC2D through the hole.

The cooling system according to the invention also comprises a three-dimensional cooling chamber Ch3D, also referred to as the 3D chamber, connected to the 2D chamber by an aperture Op. The aperture Op is configured to allow atoms 13 to pass from the 2D chamber to the 3D chamber via movement substantially along the Z-axis, as illustrated in FIG. 6. The chamber Ch3D is kept under ultra-high vacuum by a pumping system (not shown) that is connected via the duct 6.

The 3D chamber is placed at least partially inside an integrating sphere IS that is configured to illuminate the 3D chamber with a second isotropic light IL2.

The two-dimensional cooling is used to load the three-dimensional cooling chamber with pre-cooled atoms. The three-dimensional cooling allows a high number of atoms to be laser cooled ($10^9$ atoms to 100 μK in 100 ms for example).

Combined with the integrating sphere IS, the 3D chamber is configured to form a three-dimensional optical trap for atoms 13 output from the 2D chamber. Once cooled in three dimensions, the atoms form a cloud AC3D, which cloud is illustrated in FIG. 6. This cloud is then used to carry out a clock measurement, an acceleration measurement, a velocity measurement, or a rotation measurement (see method below).

Preferably, the 3D chamber Ch3D is parallelepipedal in shape and its walls are made of glass that is transparent at the wavelength of operation, which is about 780 nm for rubidium 87.

The surface 24 of the integrating sphere IS is subject to the same specifications as the integrating cylinder IC.

The cooling is achieved via illumination of the chambers by IL1 and IL2, according to a method that is described below. Just as in the prior art, in a cooling first phase Ch2D and Ch3D are illuminated with light (IL1 and IL2, respectively) having two frequencies $f_{Refroid}$ and $f_{Repomp}$, which were defined above. In contrast, in an optical pumping second step, the 3D chamber is illuminated with a single optical frequency $f_{Repomp}$. As explained below, due to the specificity of isotropic light illumination cooling, the cooling method is different from the prior-art method.

Preferably, the frequencies $f_{Refroid}$ and $f_{Repomp}$ come from two lasers L1 and L2. In the case where the internal surfaces of IC and IS are reflective (scattering, respectively), because of the reflection (scatter, respectively) of light from IC and IS, the reflected (scattered, respectively) light beams that illuminate Ch2D and Ch3D are not polarized, unlike the beams used in the prior art which had to be polarized.

The system for illuminating the 2D and 3D chambers according to the invention, which comprises an integrating cylinder and an integrating sphere, is greatly simplified with respect to the optical system of the prior art. The polarization of the light that illuminates the chambers Ch2D and Ch3D no longer needs to be controlled. The first magnetic field having a specific spatial variation that was conventionally used is no longer necessary. In addition, there is no longer any need for complex collimators to form the laser beams; it is enough to introduce light (of any polarization) into IC and IS.

According to one preferred variant, the first isotropic light IL1 and the second isotropic light IL2 respectively originate from a first and a second set of optical fibers respectively connected to the integrating cylinder and to the integrating sphere via associated inputs. Optical fibers, OF1 for IC and OF2 for IS, are illustrated in FIG. 6. The optical fibers are connected, at the other end, to both L1 and L2, to convey light from the lasers to the cylinder and sphere. The transmission of light via optical fibers is possible because there are no constraints on the polarization of the light illuminating the chambers or on the form of the beams illuminating the first chamber Ch2D and the second chamber Ch3D.

According to one embodiment, the first set consists of four multimode optical fibers OF1, the four associated inputs of which are placed so that the interior of the cylinder is uniformly illuminated.

Figure 7A:
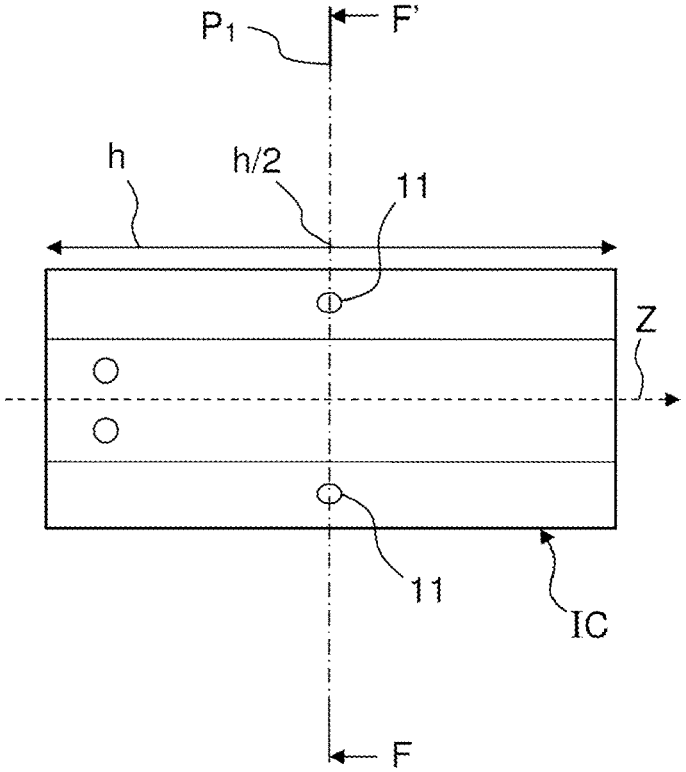
FIGS. 7*a* and 7*b* illustrate one embodiment of illumination of the 2D chamber with the integrating cylinder, via four optical fibers.
Figure 7B:
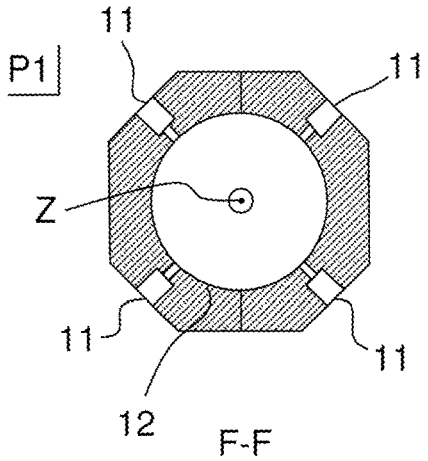

FIG. 7 illustrates one embodiment of illumination of Ch2D with the integrating cylinder IC via four optical fibers, in which the four associated inputs 11 are arranged in the same plane P1 perpendicular to the Z-axis and passing through the middle of the height h of said cylinder. The four inputs 11 are preferably spaced apart by 90°. FIG. 7*a* illustrates a side view of the cylinder IC while FIG. 7*b* illustrates a view of a cross section cut along the plane P1 defined above.

This configuration allows a light field to be obtained the distribution of the momentum of the photons of which is as isotropic as possible in an XY plane and has relatively good translational symmetry along the vertical axis of the cylinder. This momentum distribution follows the distribution of light rays in the cylinder described previously.

According to one option, the cooling system according to the invention comprises, in Ch2D, four permanent magnets placed outside the cylinder IC, in order to create a first magnetic field such as described with reference to the prior art. This field allows, if necessary, the collimation of the beam of atoms AC2D to be increased. However, it is not essential to the implementation of the cooling system.

According to one embodiment, the second set consists of four multimode optical fibers OF2, the four associated inputs being placed so that the interior of the sphere is uniformly illuminated.

Figure 8:
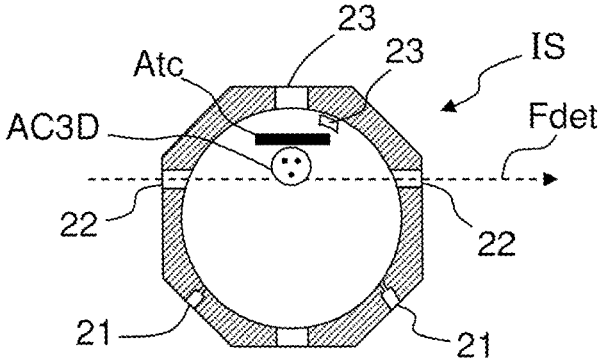
FIG. 8 illustrates an example of distribution of the four optical-fiber inputs over the integrating sphere.

FIG. 8 illustrates an example of distribution of the four associated inputs 21, in which example two thereof (not shown) are radially opposite and located on a straight line passing through the center of the sphere, the two other inputs (illustrated in FIG. 8) being located in a plane perpendicular to said straight line and containing the center of the sphere.

In the case of a cold-atom sensor based on an atom chip Atc, the latter is placed in Ch3D. In this case, the fibers passing through the inputs 21 point toward the center of the atom chip Atc. This configuration allows the maximum laser-field strength to be placed close to the atom chip, while maintaining an isotropic distribution of the momentum of the photons of the laser field.

According to one embodiment, the integrating sphere IS furthermore has two apertures 22 (illustrated in FIG. 8) allowing a detection beam Fdet to pass. This beam illuminates the cloud AC3D, which has been brought closer to the chip Atc (by a magnetic elevator that is not shown), with a view to detecting the atoms by absorption or by fluorescence (counting the number of atoms in various states to finalize the measurement).

According to one embodiment, the optical fibers OF2 are configured so that the optical field inside the sphere exhibits fine-grained speckle. By fine-grained speckle, what is meant is speckle the typical size of which is a few times the wavelength of light used for cooling.

Specifically, as explained in the literature on the subject, fine-grained speckle allows more atoms to be cooled to a few μK.

According to one embodiment, the sphere IS comprises apertures 23, one of which is illustrated in FIG. 8, allowing the electrical interconnects of the atom chip and of the magnetic elevator to pass. All the cables passing through these apertures are covered either with a material of high reflectivity or with a scattering material and the apertures are just large enough for the cables to pass. This is done to prevent photons from being absorbed into the sphere or exiting the sphere and therefore not contributing to the cooling process.

According to one embodiment, two coils (not shown) allow a magnetic-field geometry that is identical to that used in the prior-art phase of cooling AC3D to be generated. This magnetic field allows, if necessary, the spatial density of the phases of the atom cloud to be increased.

As described below, the method of cooling with the cooling system according to the invention has specific features. To be implemented it requires a uniform magnetic field to be applied to Ch3D and use of a microwave-frequency wave containing a plurality of frequencies.

Thus, according to one embodiment, the cooling system according to the invention furthermore comprises a device for generating, in the 3D chamber, a uniform magnetic field, and a device for generating, also in the 3D chamber, a microwave-frequency wave having a plurality of frequencies.

For example, the device for generating the uniform magnetic field comprises two coils 92 used in the Helmholtz configuration and placed outside the integrating sphere IS (see FIG. 9 below).

According to a first example, the device for generating the microwave-frequency wave comprises an antenna placed inside the 3D chamber.

According to a second example, for an atom-chip cold-atom sensor, the device for generating the microwave-frequency wave comprises a planar microwave guide 91 arranged on the atom chip Atc (see FIG. 9 below).

According to another aspect, the invention relates to an atom-chip cold-atom sensor 50 (illustrated in FIG. 9) comprising an atom source S, a cooling system 10 according to the invention as described above, and an atom chip Atc, for example one made of SiC (silicon carbide) or of AlN (aluminum nitride).

Figure 9:
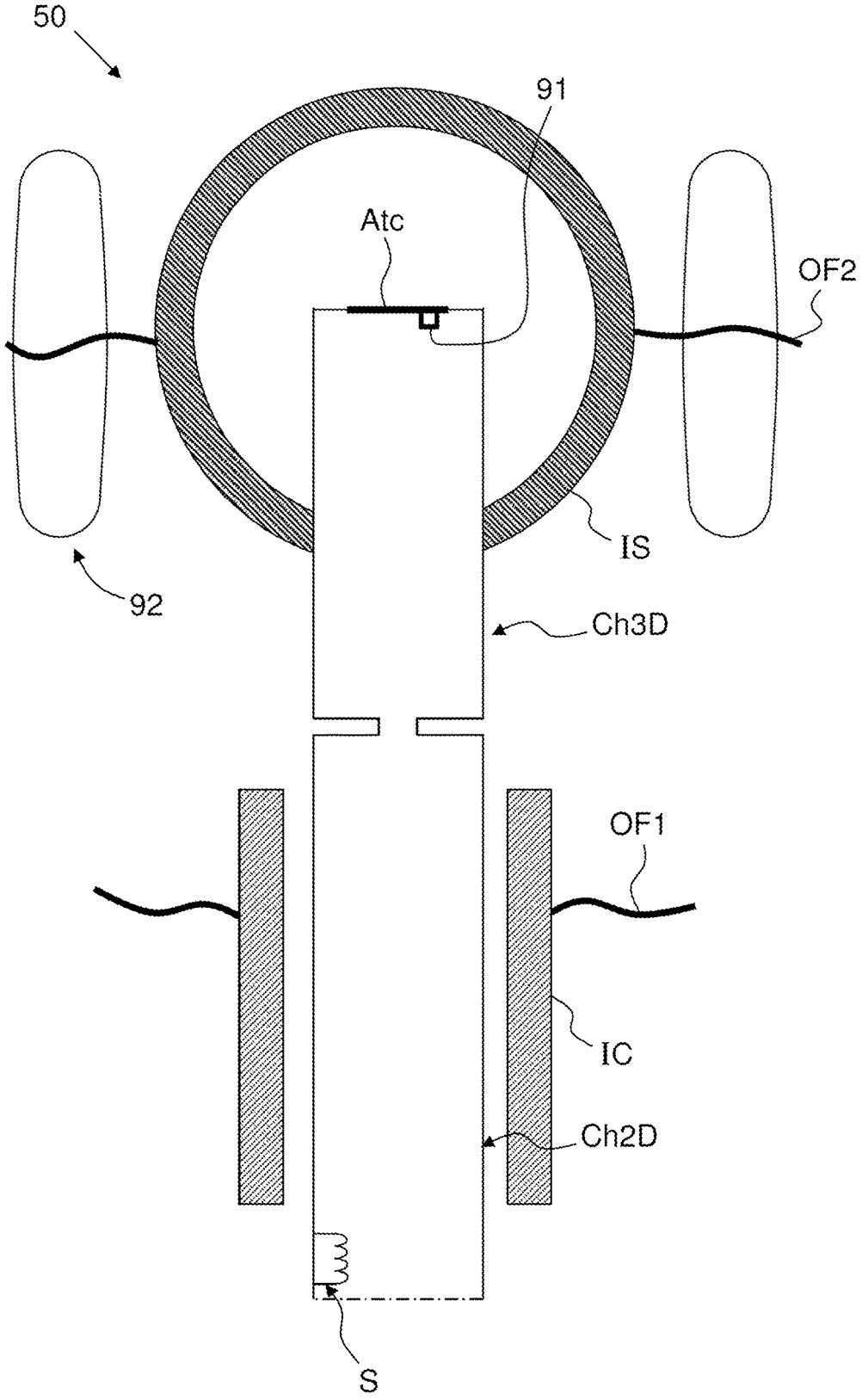
FIG. 9 illustrates an atom-chip cold-atom sensor according to the invention.

According to one option, the atom source S is placed inside Ch2D, such as illustrated in FIG. 9. According to another option, the atoms are injected into Ch2D from a source located in an additional chamber connected to the 2D chamber, for example via the duct 5.

According to a first option illustrated in FIG. 9, the chip Atc forms at least partially one of the walls of said 3D chamber.

According to a second other option, the chip Atc is placed inside the 3D chamber.

According to one embodiment, the chip Atc is transparent, and the face that is not on the side of AC3D (face that is not in vacuum for the first option) is coated with a layer configured to scatter light, such as a layer of Spectralon™, or with a reflective layer such as a layer of gold. This improves the isotropic distribution of the momentum of the photons of the cooling optical field.

Figure 10:
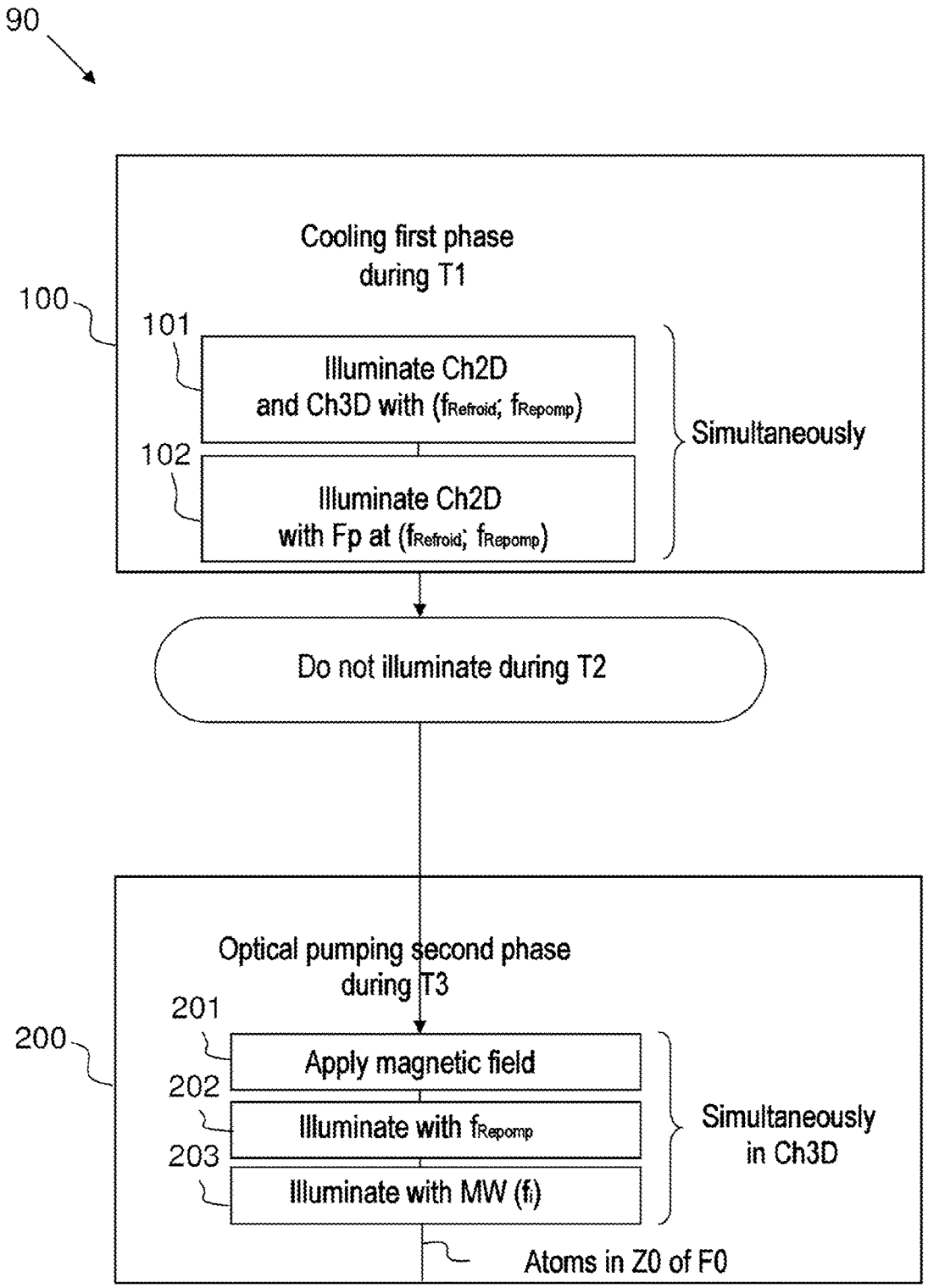
FIG. 10 illustrates a method for cooling atoms for an atom-chip cold-atom sensor, according to the invention.

According to another aspect, the invention relates to a method 90 for cooling atoms for an atom-chip cold-atom sensor, such as illustrated in FIG. 10.

The sensor comprises a two-dimensional cooling chamber Ch2D comprising 13 atoms to be cooled, said chamber being placed at least partially inside an integrating cylinder having a Z-axis, the integrating cylinder IC being configured to illuminate the 2D chamber with a first isotropic light IL1. The sensor also includes a three-dimensional cooling chamber Ch3D joined to the 2D chamber by an aperture Op configured to allow the atoms to pass from the 2D chamber to the 3D chamber via movement substantially along the Z-axis. The 3D chamber is placed at least partially inside an integrating sphere IS configured to illuminate the 3D chamber with a second isotropic light IL2.

The atoms 13 to be cooled have a first and a second ground state, said states being hyperfine (see definition above).

Just as in the prior art, the method according to the invention comprises a cooling first phase and an optical pumping second phase, but these phases have specific features due to isotropic light cooling.

The first cooling phase 100, which is implemented during a first period of time T1, consists in cooling the atoms and putting them in one of the two hyperfine ground states, which we will call F0.

For rubidium 87, this state F0 is the state denoted F=2.

Typically T1 is about 100 ms.

This first phase comprises a step 101 of illuminating the 2D chamber and the 3D chamber with the first isotropic light IL1 and the second isotropic light IL2, respectively, these isotropic lights having a cooling frequency $f_{Refroid}$ and a repump frequency $f_{Repomp}$. No specific polarization of the beams is necessary.

Figure 1:
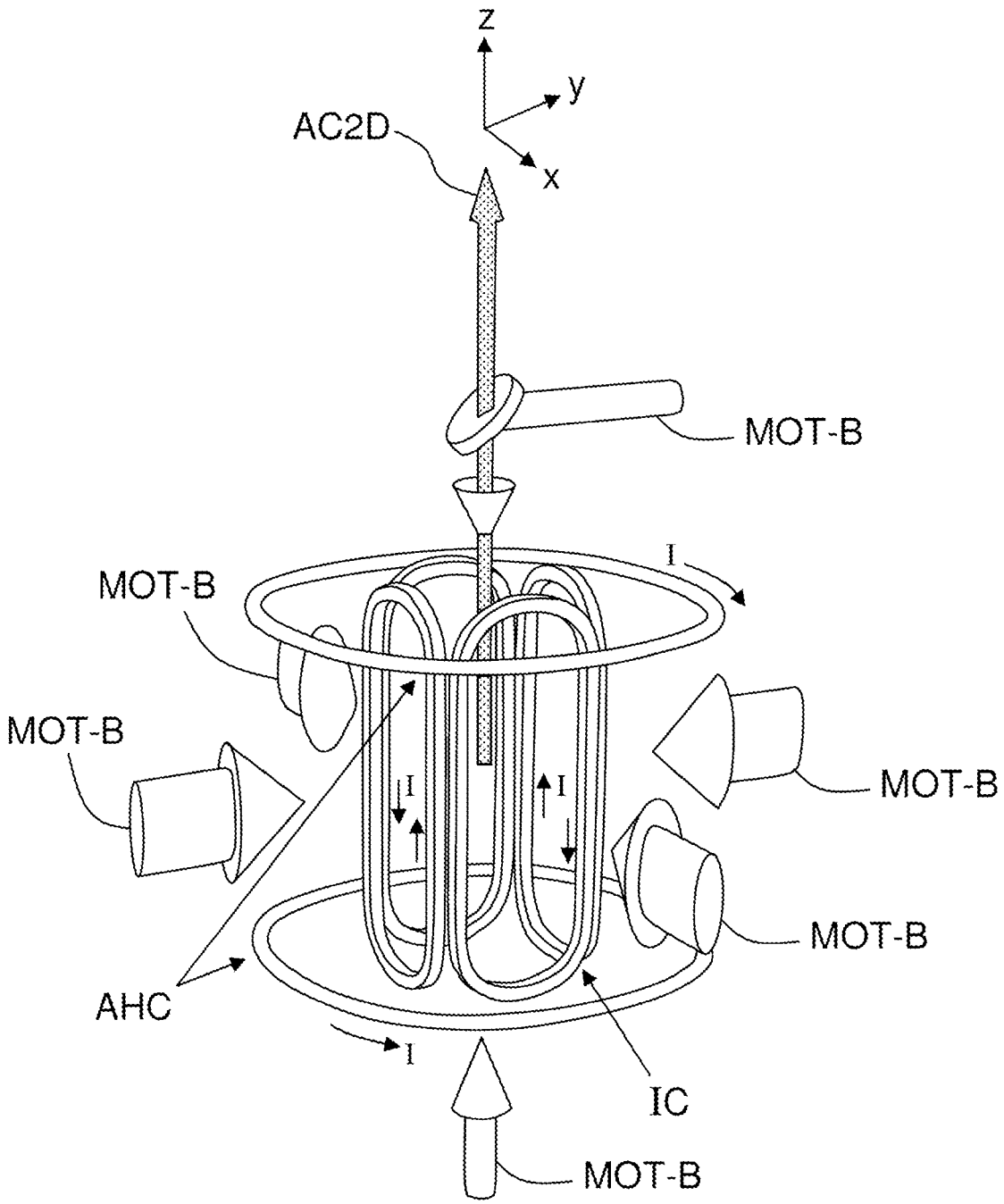
FIG.1 PRIOR ART
FIG. 1, which has already been cited, illustrates the magneto-optical trap forming the two-dimensional trap or 2D MOT according to the prior art.
Figure 2:
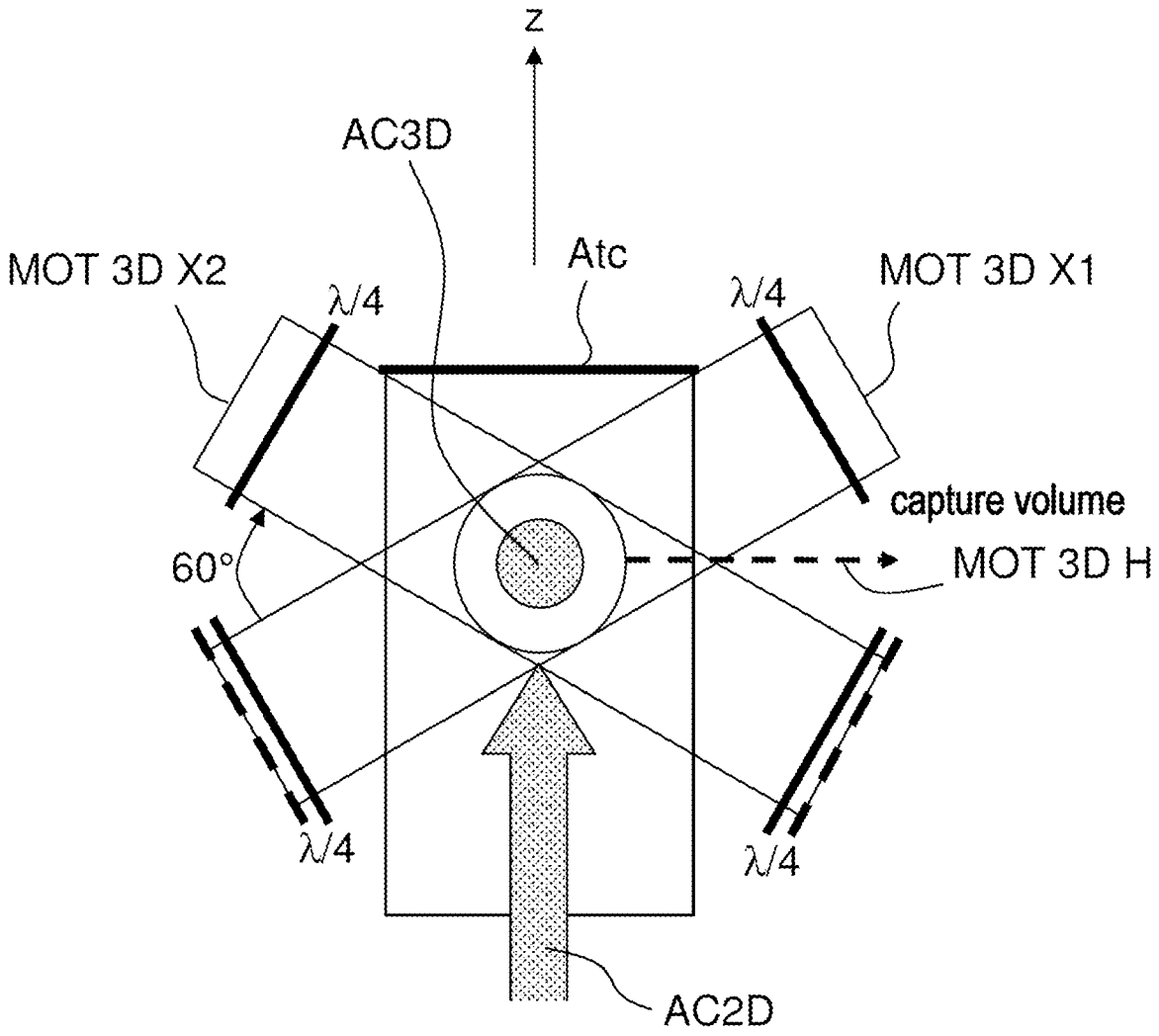
FIG.2 PRIOR ART
FIG. 2, which has already been cited, illustrates the magneto-optical trap forming the three-dimensional trap or 3D MOT according to the prior art.
Figure 3:
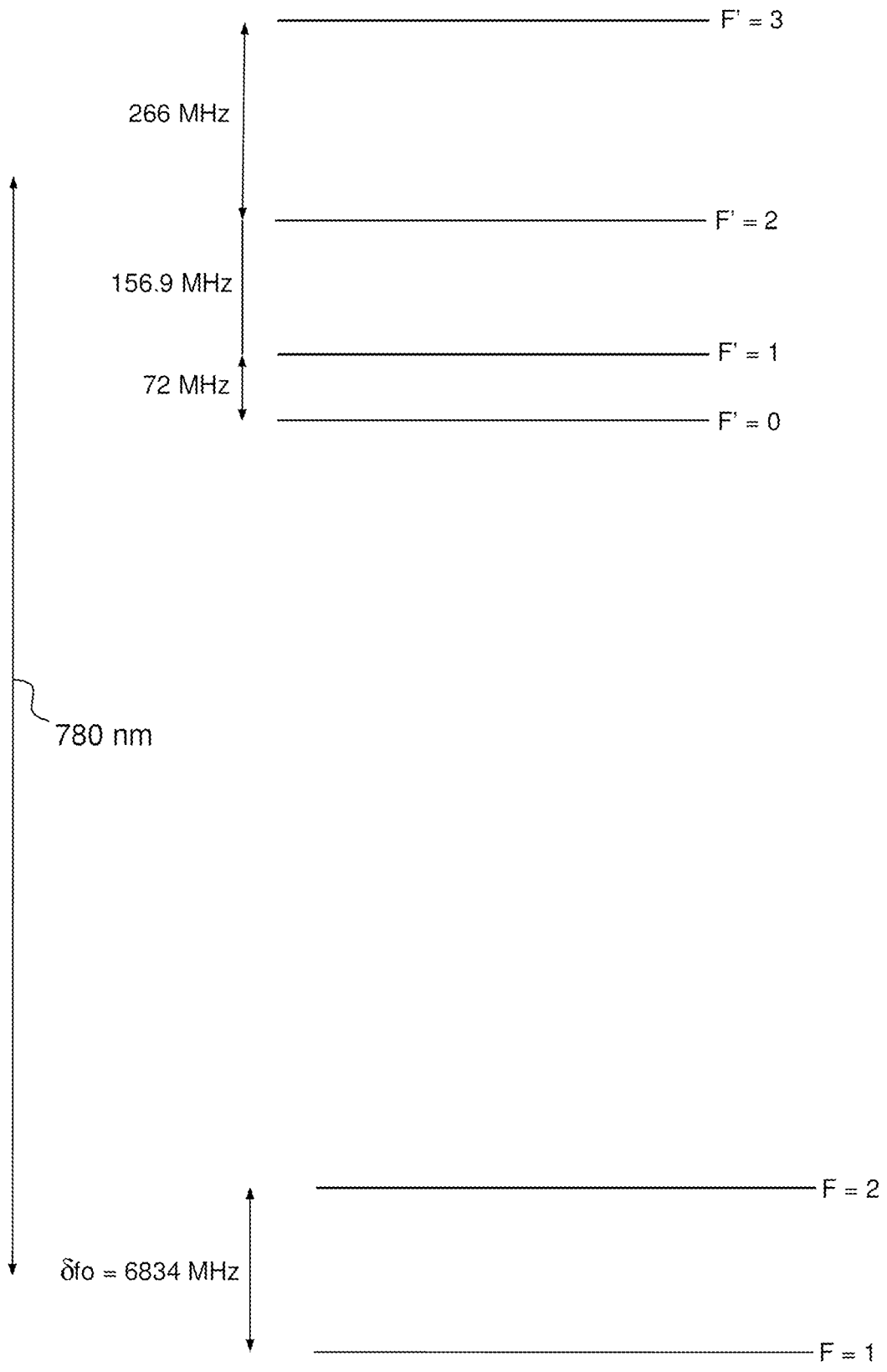
FIG.3 PRIOR ART
FIG. 3, which has already been cited, illustrates the main atomic states of interest of rubidium 87.
Figure 4:
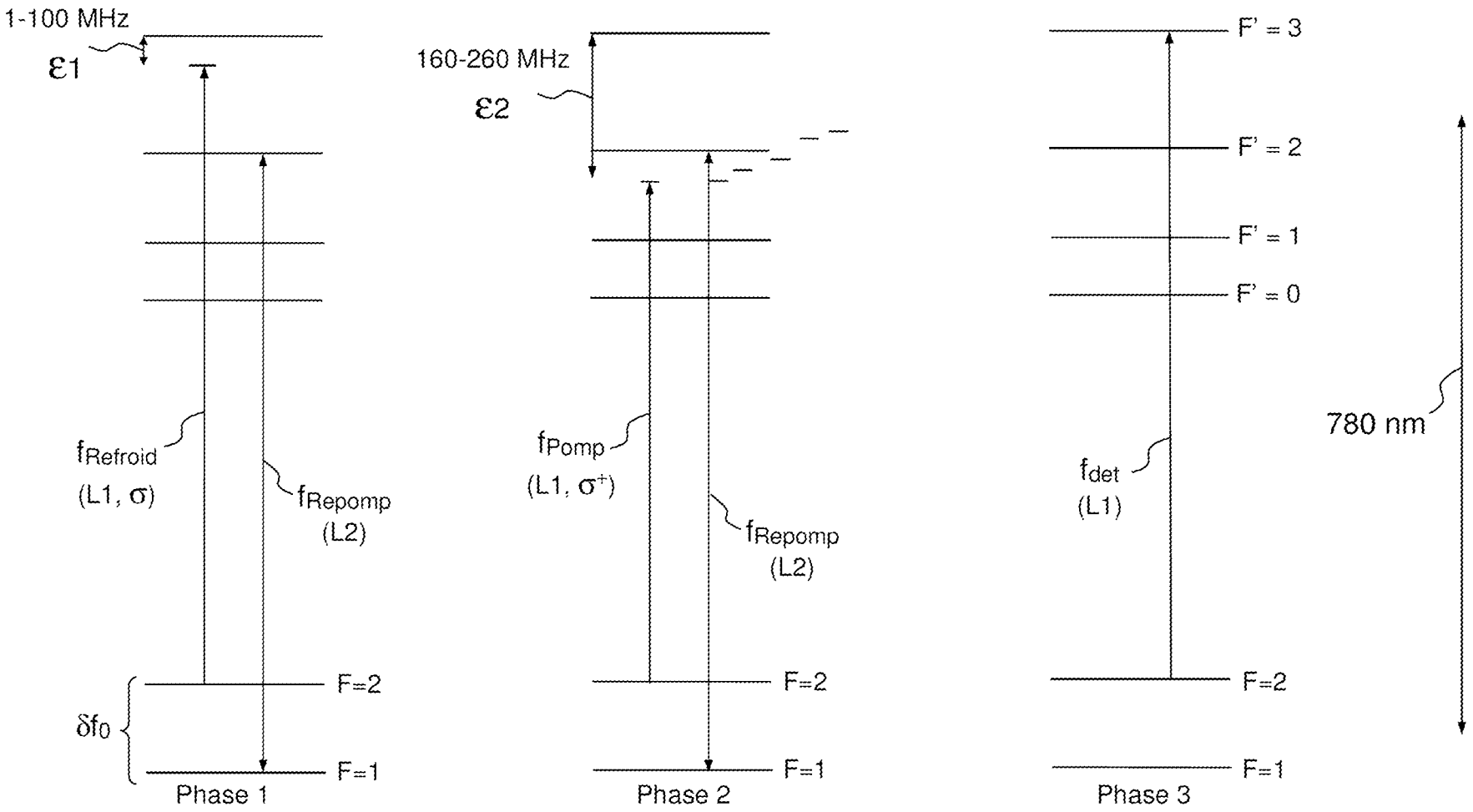
FIG.4 PRIOR ART
FIG. 4, which has already been cited, illustrates the frequencies required in the three phases of cooling, pumping and detection required to implement a cold-atom sensor according to the prior art.
Figure 5:
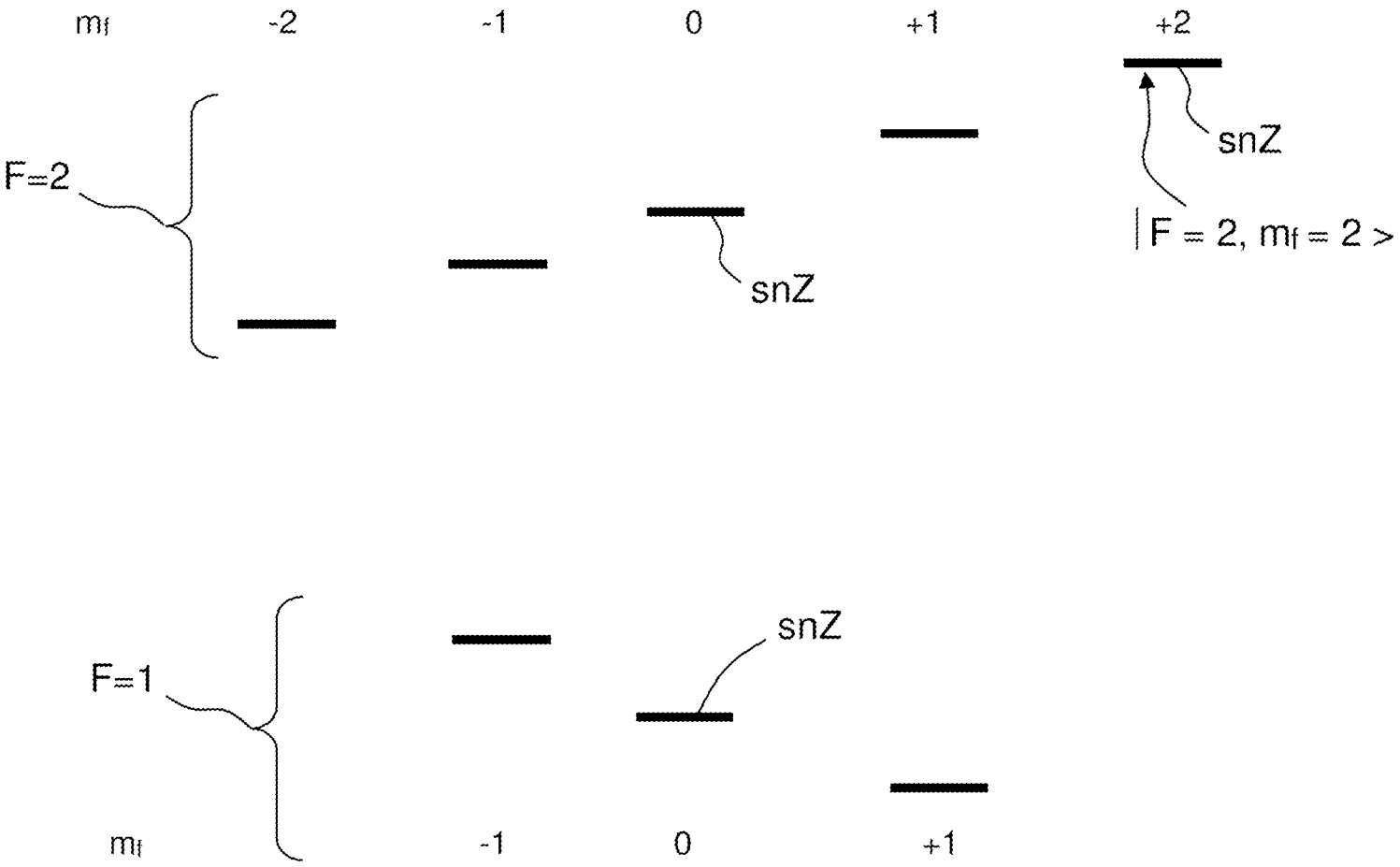
FIG.5 PRIOR ART
FIG. 5, which has already been cited, illustrates the various Zeeman sub-levels of the states F=1 and F=2 of rubidium 87.

This phase is typically implemented by turning on the cooling laser L1 and the pump laser L2 which, via optical fibers for example, illuminate the cylinder IC and the sphere IS. For example, for rubidium 87 the frequency $f_{Refroid}$ is lower than the frequency of the transition F=2→F'=3 by a quantity ε1 that is typically comprised between a few MHz and around one hundred MHz. The frequency $f_{Repomp}$ corresponds to the transition F=1→F'=2 (see FIG. 4).

Preferably, during the cooling phase, the 2D chamber is also illuminated, with a laser beam Fp called the "push" beam, along the Z-axis of the cylinder; this beam also contains the cooling frequency $f_{Refroid}$ and the repump combination of a beam output by L1 and a beam output by L2. It is therefore on at the same time as IL1 and IL2.

Next, the lights (IL1, IL2, and Fp where appropriate) are turned off for a second period of time T2, typically by turning off the lasers.

To obtain a cooling method that is rapid, it is sought to minimize the time T2. Typically T2 corresponds to 100 μs.

Typically, $10^9$ atoms at about 100 μK or a few μK are then obtained if the isotropic light IL2 contains fine-grained speckle.

After the laser-cooling phase (class 100 μK) the atoms populate all the Zeeman sub-levels of the ground state F=2 of rubidium 87.

To maximize the number of atoms trapped in the atom chip, it is necessary to optically prepare the atoms in one particular Zeeman sub-level Z0. If this is not done, a large fraction (about 80% in the case of rubidium 87) of the number of cooled atoms would be lost before the second round of cooling (radiofrequency evaporation step in the chip Atc, see the prior art).

In the case of rubidium 87 the particular Zeeman sub-level Z0 is the sub-level $|F=2;m_F=-2>$.

The method according to the invention therefore comprises a second optical pumping phase 200, implemented after having turned off the isotropic lights during the second period of time T2. This second phase is implemented during a third period of time T3 and is intended to put the atoms in a determined Zeeman sub-level Z0 of the ground state F0. Typically the time T3 is about one millisecond.

In the prior art (see prior art and FIG. 4) the following are used for this pumping phase: a uniform magnetic field (of about 2 gauss), the repump laser (for rubidium 87, set to resonate with the transition F=1→F'=2), and the cooling laser of right circular polarization, the frequency of this laser being, for rubidium 87, shifted to resonate with the transition F=2→F'=2.

However, this conventional optical pumping technique, which uses $\sigma^+$ polarized lasers, is no longer usable because the integrating sphere and cylinder do not preserve the polarization of the lasers. Thus, to benefit from the advantages of isotropic light cooling, it is necessary to implement a new optical pumping phase.

The second phase comprises the following steps, implemented simultaneously in the 3D chamber.

In a step 201, a uniform magnetic field, which has the same characteristics as the second magnetic field described with reference to the prior art, is applied.

The integrating sphere IS is also illuminated (step 202 in FIG. 10) with the second isotropic light IL2, which contains only the repump frequency $f_{Repomp}$. In this step, the repump laser L2 is typically turned on, the cooling laser L1 being turned off. Instead, the illumination is provided (step 203) by a microwave-frequency wave MW comprising a plurality of different resonant frequencies that are typically comprised between 5 and 15 GHz. Each frequency of the microwave field corresponds to a resonant frequency of a transition between a Zeeman sub-level of the first ground state and a Zeeman sub-level of the second ground state, so as to prevent the atoms from accumulating in Zeeman sub-levels other than the determined Zeeman sub-level Z0.

Figure 11:
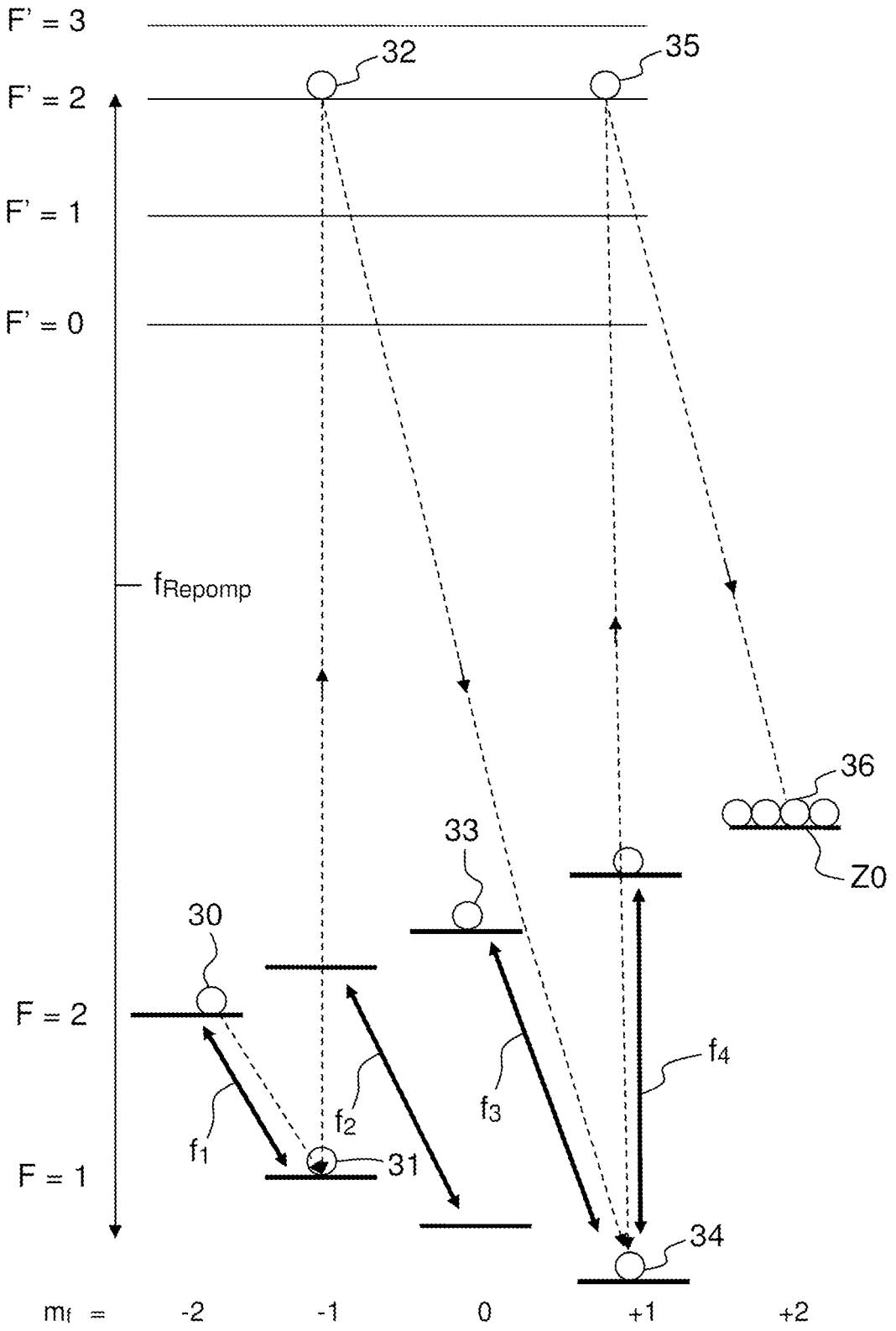
FIG. 11 illustrates the mechanism of the optical pumping second phase of the method according to invention, for the case of rubidium 87.

The mechanism is illustrated in FIG. 11, for the case of rubidium 87, which comprises 3 Zeeman sub-levels $m_F=-1$, 0 and +1 for the state F=1 and 5 Zeeman sub-levels $m_F=-2,-1$, 0, +1 and +2 for the state F=2.

Let an atom initially be in a Zeeman sub-level $|F=2;m_F=-2>$ (see the reference number 30). It will drop downward because its sub-level is resonant with the sub-level $|F=1;m_F=-1>$ via the microwave frequency f1 (reference number 31). In this sub-level of F=1, it is resonant with the repump frequency $f_{Repomp}$ and jumps to a state F' (reference number 32) then relaxes: either it drops back to whence it came and drops downward in the same way, or it drops into another sub-level, of F=2, for example $|F=2;m_F=0>$ (reference number 33). It will then drop downward because its state is resonant with the sub-level $|F=1;m_F=+1>$ via the microwave frequency f3 (reference number 34). In this sub-level of F=1, it is resonant with the repump frequency $f_{Repomp}$ and jumps to a state F' (reference number 35) then relaxes again. And so on until it reaches the sub-level $|F=2;m_F=+2>$, which is not resonant with any sub-level of F=1.

This mechanism allows the accumulation of atoms in the states $|F=1;m_F=-1,0,1>$ and $|F=2;m_F=-2,-1,0,1>$ to be prevented. The atoms are therefore forced to move into the state |F=2;m_F=2> (it is the only dark state of the system) and an accumulation of atoms in this Zeeman sub-level $|F=2;m_F=+2>$ is therefore obtained.

Thus, for the case of rubidium, the plurality of frequencies consists of four frequencies f1, f2, f3, f4 defined such that:

- a first frequency f1 corresponds to the frequency of the transition $|F=1;m_F=-1>$ to $|F=2;m_F=-2>$,
- a second frequency f2 corresponds to the frequency of the transition $|F=1;m_F=0>$ to $|F=2;m_F=-1>$,
- a third frequency f3 corresponds to the frequency of the transition $|F=1;m_F=1>$ to $|F=2;m_F=0>$, and
- a fourth frequency f4 corresponds to the frequency of the transition $|F=1;m_F=1>$ to $|F=2;m_F=1>$.

In the method according to the invention, to load the magnetic trap, optical pumping is used that combines four microwave fields and one laser field the polarization of which is random.

Figure 12:
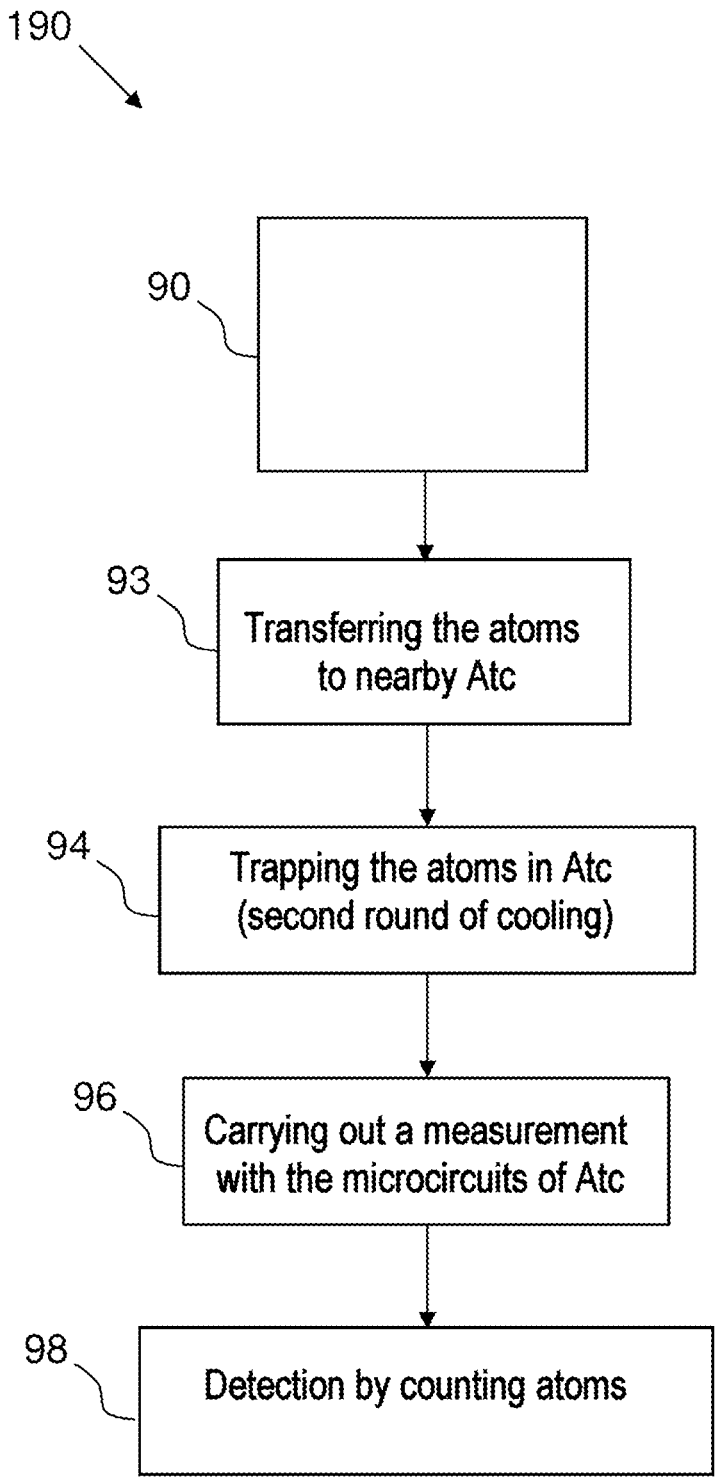
FIG. 12 illustrates a measuring method carried out using a cold-atom sensor according to the invention.

According to another aspect, the invention relates to a measuring method 190 (illustrated in FIG. 12) carried out by a cold-atom sensor comprising an atom chip Atc placed inside the 3D chamber or forming one of the walls of said 3D chamber.

The method comprises a cooling first step carried out using the cooling method 90 according to the invention, then a step 93 of transferring the atoms to nearby the atom chip with a magnetic elevator, then a step 94 of trapping said atoms in the atom chip in order to cool them again (second round of cooling).

Thus, the two-dimensional cooling is used to load the three-dimensional cooling chamber Ch3D with pre-cooled atoms. The three-dimensional cooling allows a high number of atoms to be laser cooled ($10^9$ atoms at 100 μK in 100 ms), these atoms then being transferred in the Zeeman sub-level Z0 (step 200). Next, a magnetic elevator is turned on, allowing the atoms to be transferred (step 93) to the magnetic trap created by the atom chip Atc in the vicinity thereof (step 94).

Next, in a step 96, a measurement is carried out by microcircuits present in the atom chip Atc. For example, to carry out a measurement of rotation, the atoms are placed in a coherent superposition of two Zeeman sub-levels (denoted |a> and |b>) that are then moved along a closed path containing a non-zero area. |a> and |b> are moved in opposite directions.

At the end of this measurement, the atoms in the vicinity of the chip populate various Zeeman sub-levels in a distribution that depends on the parameter that it is desired to measure.

Lastly, a detecting step 98 is carried out and consists in counting the number of respective atoms in the various Zeeman sub-levels involved in the preceding measurement. This detection is performed using a detection laser beam Fdet, which illuminates the 3D atoms located nearby the atom chip. Detection occurs via fluorescence or absorption.

The invention claimed is:

1. A cooling system for a cold-atom sensor, this system comprising:

- a two-dimensional cooling chamber, being a 2D chamber (Ch2D), kept under ultra-high vacuum and placed at least partially inside an integrating cylinder (IC) having a Z-axis, said integrating cylinder being configured to illuminate the 2D chamber with a first isotropic light (IL1), said 2D chamber comprising atoms to be cooled,
- a three-dimensional cooling chamber, being a 3D chamber (Ch3D), kept under ultra-high vacuum and joined to the 2D chamber by an aperture (Op) configured to allow said atoms to pass from the 2D chamber to the 3D chamber via movement substantially along the Z-axis, said 3D chamber being placed at least partially inside an integrating sphere (IS), said integrating sphere being configured to illuminate the 3D chamber with a second isotropic light (IL2).

2. The cooling system as claimed in claim 1, wherein the atoms are rubidium atoms.

3. The cooling system as claimed in claim 1, wherein the 2D chamber (Ch2D) is furthermore configured to be illuminated, via a porthole, with a laser beam (Fp) along the Z-axis.

4. The cooling system as claimed in claim 1, wherein the first isotropic light (IL1) and the second isotropic light (IL2) respectively originate from a first and a second set of optical fibers (OF1, OF2) respectively connected to the integrating cylinder (IC) and to the integrating sphere (IS) via associated inputs.

5. The cooling system as claimed in claim 1, wherein the first set consists of four multimode optical fibers (OF1), the four associated inputs being placed in the same plane (P1) perpendicular to the Z-axis and passing through the middle of the height (h) of said cylinder, and being spaced apart by 90°.

6. The cooling system as claimed in claim 1, wherein the second set consists of four multimode optical fibers (OF2), the four associated inputs being placed so that two thereof are radially opposite and located on a straight line passing through the center of the sphere, the two other inputs being located in a plane perpendicular to said straight line and containing the center of the sphere.

7. The cooling system as claimed in claim 1, wherein the integrating sphere (IC) furthermore has two apertures allowing a detection beam (Fdet) to pass.

8. The cooling system as claimed in claim 1, wherein the optical fibers are configured so that an optical field inside the sphere exhibits fine-grained speckle.

9. The cooling system as claimed in claim 1, wherein the internal surface of said integrating cylinder and the internal surface of the integrating sphere are each either a high-reflectivity mirror, or perfectly scattering.

10. The cooling system as claimed in claim 1, furthermore comprising a device for generating a uniform magnetic field in the 3D chamber, and a device for generating a microwave-frequency wave that propagates into the 3D chamber, said microwave-frequency wave having a plurality of frequencies.

11. An atom-chip cold-atom sensor comprising:

an atom source (S)

a cooling system as claimed in claim 1, an atom chip (Atc) placed inside the 3D chamber or forming at least partially one of the walls of said 3D chamber.

12. The sensor as claimed in claim 11, wherein the atom chip (Atc) forms at least partially one wall of the 3D chamber and is transparent, a face that is not in vacuum being coated with a scattering or reflective layer.

13. A method for cooling atoms for an atom-chip cold-atom sensor, said sensor comprising:

a two-dimensional cooling chamber, being a 2D chamber (Ch2D), kept under ultra-high vacuum and comprising atoms to be cooled, said 2D chamber being placed at least partially inside an integrating cylinder having a Z-axis, said integrating cylinder being configured to illuminate the 2D chamber with a first isotropic light, a three-dimensional cooling chamber, being a 3D chamber (Ch3D), kept under ultra-high vacuum and joined to the 2D chamber by an aperture configured to allow said atoms to pass from the 2D chamber to the 3D chamber via movement substantially along the Z-axis, said 3D chamber being placed at least partially inside an integrating sphere configured to illuminate the 3D chamber with a second isotropic light, said atoms to be cooled having a first and a second ground state, said states being hyperfine, the method comprising:

a cooling first phase implemented during a first period of time (T1) consisting in cooling the atoms and in placing them in one of the two hyperfine ground states (F0), this comprising a step of illuminating the 2D chamber and the 3D chamber with the first and second isotropic light, respectively, said isotropic lights having a cooling frequency ($f_{Refroid}$) and a repump frequency ($f_{Repomp}$), an optical pumping second phase, implemented after the isotropic lights have been turned off during a second period of time (T2), said second phase being implemented during a third period of time (T3) and being intended to place the atoms in a determined Zeeman sub-level (Z0) of the ground state (F0), said second phase comprising steps, implemented simultaneously in the 3D chamber, of:

applying a uniform magnetic field, illuminating with the second isotropic light having the repump frequency ($f_{Repomp}$), illuminating with a microwave-frequency wave having a plurality of different frequencies, each frequency corresponding to a resonant frequency of a transition between a Zeeman sub-level of the first ground state and a Zeeman sub-level of the second ground state.

14. The method as claimed in claim 13, wherein, during the cooling phase, the 2D chamber is also illuminated, along the Z-axis of the cylinder, with a laser beam (Fp) having the cooling frequency ($f_{Refroid}$) and the repump frequency ($f_{Repomp}$).

15. The method as claimed in claim 13, wherein the atoms to be cooled are atoms of rubidium 87, the two hyperfine ground states being F=1 and F=2, the ground state (F0) being the state F=2 and the predetermined Zeeman sub-level (Z0) being the sub-level denoted $|F=2;m_F=2>$, with F the atomic angular momentum and $m_F$ the projection of the atomic angular momentum onto a quantification axis, and wherein the plurality of frequencies consists of four frequencies (f1, f2, f3, f4 with:

a first frequency (f1) corresponding to the frequency of the transition $|F=1;m_F=-1>$ to $|F=2;m_F=-2>$, a second frequency (f2) corresponding to the frequency of the transition $|F=1;m_F=0>$ to $|F=2;m_F=-1>$, a third frequency (f3) corresponding to the frequency of the transition $|F=1;m_F=1>$ to $|F=2;m_F=0>$, and a fourth frequency (f4) corresponding to the frequency of the transition $|F=1;m_F=1>$ to $|F=2;m_F=1>$.

* * * * *